US005626645A

United States Patent [19]

Bamberger

[11] Patent Number: 5,626,645

[45] Date of Patent: May 6, 1997

[54] PROCESS FOR MAKING SILVER METAL FILAMENTS

[75] Inventor: Carlos E. Bamberger, Oak Ridge, Tenn.

[73] Assignee: The United States of America as represented by the Department of Energy, Washington, D.C.

[21] Appl. No.: 534,438

[22] Filed: Sep. 27, 1995

[51] Int. Cl.[6] ..... B22F 9/24

[52] U.S. Cl. ..... 75/366; 75/368; 75/369; 75/636

[58] Field of Search ..... 75/363, 366, 367, 75/368, 369, 636, 720

[56] References Cited

U.S. PATENT DOCUMENTS

| | | | |
|---|---|---|---|
| 2,758,021 | 8/1956 | Drapeau et al. | 75/366 |
| 3,877,931 | 4/1975 | Neskora et al. | 75/720 |
| 3,940,261 | 2/1976 | Dannelly et al. | 420/501 |
| 4,883,559 | 11/1989 | Bamberger | 156/603 |
| 4,994,107 | 2/1991 | Flagan et al. | 75/367 |
| 5,118,488 | 6/1992 | Bamberger | 423/409 |
| 5,188,660 | 2/1993 | Tosun et al. | 75/370 |
| 5,389,122 | 2/1995 | Glicksman | 75/370 |
| 5,439,502 | 8/1995 | Kodas et al. | 75/369 |

FOREIGN PATENT DOCUMENTS

| | | | |
|---|---|---|---|
| 59-116302 | 7/1984 | Japan | 75/366 |

OTHER PUBLICATIONS

Bamberger, The pseudomorphic conversion of acicular crystals of sodium tungsten bronze into WC/W.J. of Mats. Sci. Let. 13(1994) 1742–1745.

Bamberger, et al, Acicular crystals of sodium tungsten bronzes, Journal of Crystal Growth 131 (1993) 473–480.

Silber, Gmelins Handbuch der Anorganishen Chemie, A2;61, (1970) pp. 67, 157–159.

Ohachi, et al, The Growth and Morphology of Silver Whiskers, Journal of Crystal Growth, 24/25 (1974) pp. 362–366.

Varleva, et al, The Growth of Silver Whiskers by Reduction of Silver Halogenides, Cryst. Res. Technol. 28 (1993) pp. 441–448.

Silber, Gmelins Handbuch der Anorganischen, Chemie, 61; B5 (1975) pp. 121–135, 139–142.

Bamberger, Preparation of Silver Filaments (unpublished manuscript) submitted for publication Dec. 1994, accepted for publication May 1995 in Journal of Materials Science Letters.

*Primary Examiner*—George Wyszomierski

*Attorney, Agent, or Firm*—Emily G. Schneider; Stephen D. Hamel; William R. Moser

[57] ABSTRACT

A process for making silver metal particles from silver salt particles having the same morphology. Precursor silver salt particles selected from the group consisting of silver acetate and silver sulfide having a selected morphology are contained in a reactor vessel having means for supporting the particles in an air suspension to prevent the agglomeration of the particles. Air is flowed through the reactor vessel at a flow rate sufficient to suspend the particles in the reactor vessel. The suspended precursor silver salt particles are heated to a processing temperature and at a heating rate below which the physical deterioration of the suspended precursor silver salt particles takes place. The suspended precursor silver salt particles are maintained at the processing temperature for a period of time sufficient to convert the particles into silver metal particles having the same morphology as the precursor silver salt particles.

12 Claims, 1 Drawing Sheet

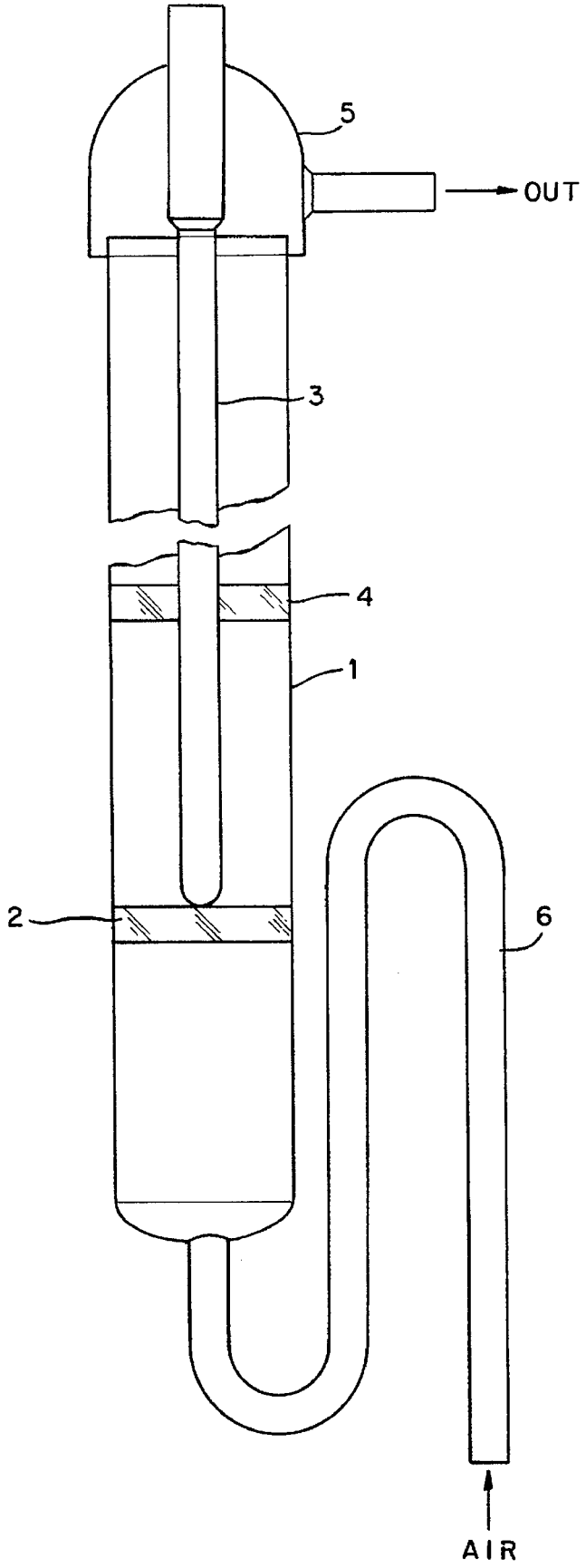
5
OUT
3
4
1
2
6
AIR

PROCESS FOR MAKING SILVER METAL FILAMENTS

BACKGROUND OF THE INVENTION

This invention relates generally to a process for making filaments of metal compounds and more particularly to a process for making silver metal filaments. The United States Government has rights to this invention pursuant to Contract No. DE-AC05-84OR 21400 with Lockheed Martin Energy Systems, Inc. awarded by the U.S. Department of Energy.

Particles of metal compounds may be made in many forms, including but not limited to, filaments, spheres, flakes and platelets, depending on their desired use. Metallic filaments, also called whiskers when single crystals, are characterized by relatively high tenacity and extremely high aspect ratio, i.e. high ratio of length to diameter. Much research has been done in the area of improving the performance of ceramics in the areas of cutting tools and engine parts by incorporating whiskers into the ceramic matrix. Another use for metallic filaments is as substrates for the deposition of high temperature superconductors. Silver in particular is a preferred substrate material for cuprate superconductors because of its resistance to oxidation at elevated temperatures in an oxidizing atmosphere. Such conditions are required to form the superconducting phase. Silver is also a preferred substrate material because it is chemically inert to superconducting materials. In addition, silver metal filaments may provide the necessary orientation for some superconductors to allow high current passage. For example, bismuth-lead-calcium strontium copper oxide and thallium-barium-calcium copper oxide superconductors require C-axis texture with some in-plane orientation.

Several methods for making silver metal filaments are known. These methods are based on several techniques including: (1) chemical reduction of silver salts (e.g. AgCl, AgI) by hydrogen and $Ag^+$ by $Fe^{2+}$ in aqueous perchlorate solution, (2) electrolysis of aqueous solutions (e.g. $AgNO_3$) and of molten salts (e.g. AgCl, AgBr), (3) condensation of supersaturated silver vapor, (4) thermal decomposition of silver compounds such as $Ag_2S$, and (5) electrochemical growth from substrates such as $Ag_2S$. However, these methods are limited for use in the above described applications since the filaments produced by these methods have sharp bends and kinks and their resulting morphology cannot be predicted. Furthermore, a small number of filaments, sufficient only for microscopic examination, is produced. Accordingly, a need in the art exists for a process for making silver metal particles which produces particles of preselected morphology and consistently high yields.

SUMMARY OF THE INVENTION

In view of the above need, it is an object of this invention to provide a process for making silver metal particles which produces particles of preselected morphology.

Another object of this invention is to provide a process as in the above object that produces high yields.

Briefly, the present invention is a process for making silver metal particles from silver salt particles having the same morphology, comprising the steps of: providing precursor silver salt particles selected from the group consisting of silver acetate and silver sulfide having a selected morphology; containing the precursor silver salt particles in a reactor vessel having means for supporting the particles in an air suspension to prevent the agglomeration of said particles; flowing air through the reactor vessel at a flow rate sufficient to suspend the particles in the reactor vessel; heating the suspended precursor silver salt particles simultaneously with the flowing step to a processing temperature and at a heating rate below which physical deterioration of the suspended precursor silver salt particles takes place; and maintaining the suspended precursor silver salt particles at the processing temperature for a period of time sufficient to convert the particles into silver metal particles having the same morphology as the precursor silver salt particles.

One advantage of this invention is that one can begin with a starting material having particles of a preselected shape and be assured that the morphology will remain in the final product. In addition, the yield of final product with preselected morphology is in a quantity sufficient for a number of applications, such as in the ceramic and superconductor areas.

Additional objects, advantages, and novel features of the invention will be set forth in part in the description which follows, and in part will become apparent to those skilled in the art upon examination of the following or may be learned by the practice of the invention. The objects and advantages may be realized and attained by means of the instrumentalities and combinations particularly pointed out herein and in the appended claims.

BRIEF DESCRIPTION OF THE DRAWING

The single figure is a schematic diagram of the system used in the laboratory preparation of the silver metal particles in accordance with the present invention.

DETAILED DESCRIPTION OF THE PREFERRED EMBODIMENT

Selection of the starting material for the process of the present invention is an important element. The examples disclosed here use filaments as the starting material, however, the shape and size of the starting material may be varied depending on the form that is desired for the product. For example, one may also use particles which are in the shape of spheres, platelets, whiskers, or flakes as the starting material. Because the reaction is topochemical, that is it starts on the surface of the solid, the shape of the particle is not disturbed from the starting material to the final product.

More specifically, the particles used as the starting material in the process of this invention are filaments of silver salts, including, but not limited to, silver acetate and silver sulfide. Filaments of silver acetate, AgAcO, were prepared by adding 300 ml of 0.5M $AgNO_3$ solution to 1000 ml hot 0.2M sodium acetate, NaAcO, solution while stirring, followed by evaporation of the clear solution to a volume of 600–800 ml. The rate of cooling determined the size of the filaments. Slow cooling on a hot plate produced large filaments, up to 25 mm in length, whereas rapid cooling by immersing the hot solution in a 0° C. bath produced shorter and thinner filaments from about 1 mm to 5 mm in length. The silver acetate filaments were washed with ethanol and dried with air on a glass frit filter. The yield from one crystallization step was about 50% and increased to a total of about 75% by successive cycles of evaporation and crystallization.

Preparation of silver sulfide filaments can be represented by the reaction:

$$2AgOOC—CH_3+H_2S \rightarrow Ag_2S+2HOOC—CH_3 \quad [1]$$

Silver acetate filaments, ranging in size from about 1 mm to 25 mm, were exposed to hydrogen sulfide gas to produce silver sulfide filaments. At room temperature, it was found that the hydrogen sulfide needed to be diluted with argon (or any other inert gas) to partial pressures of 0.001–0.004 atm to avoid a rapid reaction which is conducive to the strong agglomeration of the silver sulfide filaments (formation of clumps). The resulting silver sulfide filaments were air dried and their size remained essentially the same as the silver acetate filaments.

Preliminary experiments involved decomposing the silver salt filaments, contained in an alumina boat, by heating them under flowing argon-4% hydrogen or air. The product obtained with 4% hydrogen consisted of a metallic "wool" composed of thin, irregularly shaped particles. However, the product obtained with air consisted of silver metal filaments that retained the morphology of the precursor silver salt filaments. The resulting silver metal filaments, however, were stuck to each other forming clumps, and this suggested performing the decomposition in a configuration in which a gaseous stream of sufficient velocity would suspend the precursor silver salt filaments while preventing the agglomeration of the resulting silver metal filaments. Accordingly, a reactor vessel was designed, as shown in the Figure, in which to perform the process of the present invention. The reactor vessel was built of vitreous silica and consisted of a tall cylinder 1 with a permanently attached coarse silica frit 2 for supporting the precursor silver salt filaments. A thermocouple well 3 with another attached frit 4 for preventing smaller filaments from being blown out was slid into the cylinder so that the thermocouple registered the temperature at the lower, supporting frit and provided a reaction chamber in which 2–3 g of filaments occupied about one third of its volume. The connection of the cylinder with the thermocouple well was made by means of a glass "Ace" joint 5 which also provided for the exit of the air. The folded, long path of the silica inlet tubing 6 served the purpose of preheating the incoming air and thus decreasing the temperature gradient between the two frits. The flow rate of pressurized air (from an in-house compressor) was measured with a wet test meter.

The stoichiometry of the reactions of silver acetate filaments and silver sulfide filaments with air to produce silver metal filaments is as follows:

$$AgOOC—CH_3+1.75O_2 \rightarrow Ag+2CO_2+3/2H_2O \quad [2]$$

$$Ag_2S+O_2 \rightarrow 2Ag+SO_2 \quad [3]$$

In the process of the present invention, the following variables have considerable effect on the final product: 1) rate of heating, 2) maximum temperature, 3) time at maximum temperature, and 4) flow rate of air.

EXAMPLES

The following examples are given to illustrate the process of the present invention and are not to be taken as limiting the scope of the invention which is defined in the appended claims.

Example 1

Precursor silver acetate filaments were prepared as described above and 2–3 grams were placed in the reactor between the two frits (2 and 4 in FIG.). The reactor was placed in a furnace and air flow was started, regulated by a valve on a flowmeter, and entered the reactor through the tubing 6. The furnace was heated at a rate of 0.5° C. to 1° C./minute to a predetermined temperature and held for at least 4 hours. Slow heating to the predetermined temperature prevented the physical deterioration of the silver acetate filaments. Once the reaction was complete, the furnace was turned off and the resulting silver metal filaments were cooled under the same air flow to room temperature. Once cooled, the silver metal filaments, ranging in size from about 1 mm to about 25 mm, were recovered from the reactor and weighed. The actual weight change (40%) recorded corresponded with the theoretical weight change of 35.4%.

The most favorable results for the decomposition of the large precursor silver acetate filaments (about 25 mm long) into silver metal filaments were obtained with heating rates of about 0.5° C. to 1° C./minute to temperatures of about 450° C. to 650° C. and air flow rate from about 8 to 12 liters/minute. Smaller silver acetate filaments (up to 5 mm long) required slightly different maximum temperatures, about 475° C. to 530° C. Using this range of temperatures, the resulting silver metal filaments retained the morphology of the precursor silver acetate filaments. Higher temperatures, e.g. about 580° C. to 650° C., yielded filaments that were so strongly agglomerated in clumps that the application of ultrasound to the clumps placed in water did not deagglomerate them. Lower temperatures, e.g. about 360° C. to 520° C., produced very few filaments together with mainly irregularly shaped particles arranged in a mass resembling a sponge.

Example 2

Precursor silver sulfide filaments were prepared as described above and 2–3 grams were contained in the reactor between the two frits (2 and 4 in FIG.). The reactor was placed in a furnace and air flow was started, regulated by a valve on a flowmeter, and entered the reactor through the tubing 6. The furnace was heated at 0.5° C. to 3° C./minute to a predetermined temperature and held for at least 4 hours. Slow heating to the predetermined temperature prevented the physical deterioration of the silver sulfide filaments. Once the reaction was complete, the furnace was turned off and the resulting silver metal filaments were cooled under the same air flow to room temperature. Once cooled, the silver metal filaments, ranging in size from about 1 mm to about 25 mm, were recovered from the reactor and weighed.

The weight change registered for the conversion of silver sulfide to silver metal, about 9%, was smaller than the value expected (12.9%) for the chemical equation [3]. No sulfur was found by analysis in the silver metal product while on melting in air the silver lost between 0.6 to 4% weight. This was interpreted to be caused by the presence of oxygen in the silver metal filaments, which after release on melting was not reabsorbed because the silver surface area had significantly shrunk. If the excess oxygen in the filaments were to constitute a problem for their use, the filaments could be cooled in a stream of an inert gas, i.e. Ar, He, $N_2$, rather than air.

The most favorable results, in terms of retention of the preselected shape and size of the precursor silver sulfide filaments and light binding among filaments were obtained at heating rates between about 0.5° C. and 3° C./minute to temperatures between about 500° C. and 630° C., and air flow rate of about 4 to 8 liters/minute. Examination of the resulting silver metal filaments by scanning electron microscopy revealed that the filaments had rough surfaces which were not substantially different from the surfaces of the filaments obtained from silver acetate filaments.

As can be seen, one advantage of the process of this invention is that the morphology of the resulting product can be preselected based on the morphology of the starting material. However, it is generally known to those skilled in the art that the results of a chemical reaction cannot be accurately predicted in terms of morphology of the starting material and products in all situations. For example, prior research has shown that while potassium titanate whiskers can be converted to titanium nitride whiskers, they cannot be converted to titanium carbide whiskers and the conversion of potassium niobate whiskers into niobium nitride or carbide whiskers was not successful. In addition, while the conversion of sodium tungsten bronze whiskers to whiskers of 80% tungsten carbide/20% tungsten takes place, the conversion to tungsten nitride whiskers did not occur.

This process is relatively simple and does not require stringent control of parameters such as purity of reagents and pressure. The reaction is sensitive to the reactor vessel dimensions and configuration; however, ascertaining the appropriate vessel for a scaled up or scaled down version of this process would be within the skill of the art.

The process of the present invention can be used to prepare silver metal particles with preselected morphology, and more particularly, silver metal filaments, in quantities sufficient for use in a number of applications such as superconductor and ceramic research and technology.

I claim:

1. A process for making silver metal particles from silver salt particles having the same morphology, comprising the steps of:

a) providing precursor silver salt particles selected from the group consisting of silver acetate end silver sulfide having a selected morphology;

b) containing said precursor silver salt particles in a reactor vessel having means for supporting said particles in an air suspension to prevent the agglomeration of said particles;

c) flowing air through said reactor vessel at e flow rate sufficient to suspend said particles in said reactor vessel;

d) heating said suspended precursor silver salt particles simultaneously with said flowing step to a processing temperature and at a heating rate below which physical deterioration of said suspended precursor silver salt particles takes place; and e) maintaining said suspended precursor silver salt particles at said processing temperature for a period of time sufficient to convert said particles into silver metal particles having the same morphology as said precursor silver salt particles.

2. The process of claim 1, further including the step of cooling said silver metal particles under said flowing air to room temperature.

3. The process of claim 2, wherein said time of maintaining said processing temperature is not less than 4 hours.

4. The process of claim 3, wherein said selected morphology of said silver metal particles is filamentous.

5. The method of claim 4, wherein said flow rate of said flowing air is in the range of from about 4 to 12 liters/minute.

6. The method of claim 5, wherein said predetermined temperature is in the range of from about 450° C. to 650° C. and said heating rate is in the range of from about 0.5° C. to 3° C./minute.

7. The method of claim 6, wherein said precursor silver salt particle is silver acetate.

8. The method of claim 7, wherein said flow rate of said flowing air is in the range from about 8 to 12 liters/minute.

9. The method of claim 8, wherein said processing temperature is in the range of from about 450° C. to 650° C. and said heating rate is in the range of from about 0.5° C. to 1° C./minute.

10. The method of claim 6, wherein said precursor silver salt particle is silver sulfide.

11. The method of claim 10, wherein said flow rate of said flowing air is in the range from about 4 to 8 liters/minute.

12. The method of claim 11, wherein said processing temperature is in the range of from about 500° C. to 630° C. and said heating rate is in the range of from about 0.5° C. to 3° C./minute.

* * * * *